US006315647B1

(12) United States Patent
Ghilardi

(10) Patent No.: US 6,315,647 B1
(45) Date of Patent: Nov. 13, 2001

(54) SANDING MACHINE

(76) Inventor: Pierangelo Ghilardi, 372 Ridgewood Ave., Charlotte, NC (US) 28209

( * ) Notice: Subject to any disclaimer, the term of this patent is extended or adjusted under 35 U.S.C. 154(b) by 0 days.

(21) Appl. No.: 09/137,469

(22) Filed: Aug. 20, 1998

(51) Int. Cl.[7] ..... B24C 3/00
(52) U.S. Cl. ..... 451/75; 451/87; 451/344
(58) Field of Search ..... 451/75, 87, 88, 451/344, 350, 353, 354, 357, 359, 259

(56) References Cited

U.S. PATENT DOCUMENTS

| | | | | |
|---|---|---|---|---|
| 1,800,341 | * | 4/1931 | Davies | 451/359 |
| 3,646,712 | * | 3/1972 | Quintana | 451/359 |
| 3,872,627 | | 3/1975 | Schuster . | |
| 4,058,936 | | 11/1977 | Marton . | |
| 4,091,577 | * | 5/1978 | Ortiz | 451/359 |
| 4,164,101 | | 8/1979 | Robert . | |
| 4,923,251 | * | 5/1990 | Funakwaw et al. | 451/354 |
| 5,131,192 | | 7/1992 | Cheng . | |
| 5,297,363 | * | 3/1994 | Schroder et al. | 451/354 |
| 5,428,865 | * | 7/1995 | Yarbrough | 451/354 |
| 5,713,785 | | 2/1998 | Nishio . | |
| 5,775,979 | * | 7/1998 | Coke et al. | 451/354 |

* cited by examiner

*Primary Examiner*—Derris H. Banks

(57) ABSTRACT

A sanding machine with a hand-held sanding unit, with interchangeable heads, connected to a base unit, containing three motors, one to provide suction of debris back through a hose, which has an inner hose containing a driver cable and self lubricating material, which allows the transportation of debris back to the base unit collection unit, connecting the base unit and hand-held unit, a second motor to power a driver cable which turns the hand-held unit, a third motor which is encased inside a collection unit, inside the base unit, which generates electromagnetic vibrations causing filters to release accumulated debris by the interaction of an inner and outer spring.

1 Claim, 5 Drawing Sheets

FIGURE #1
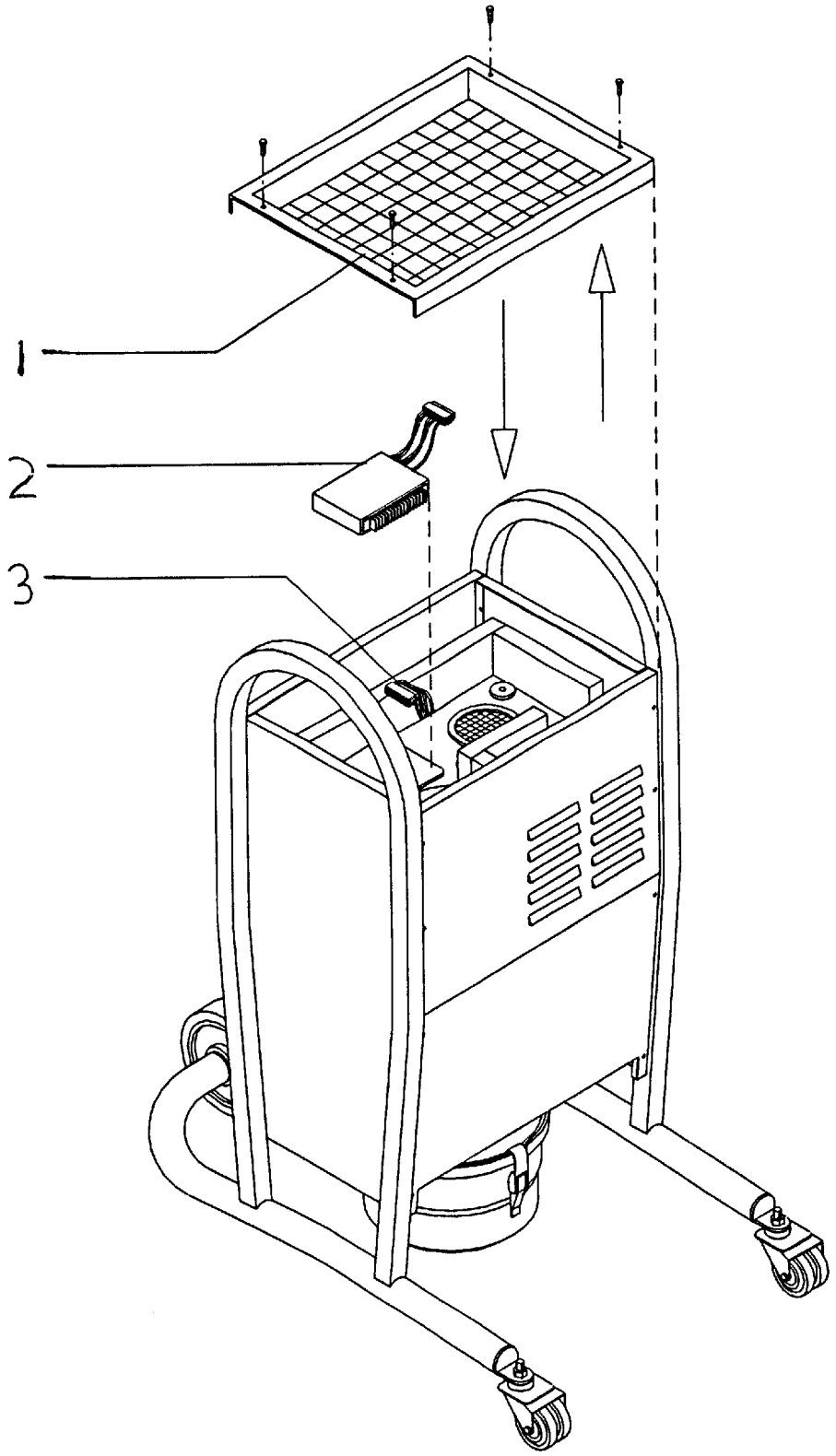

FIGURE #2
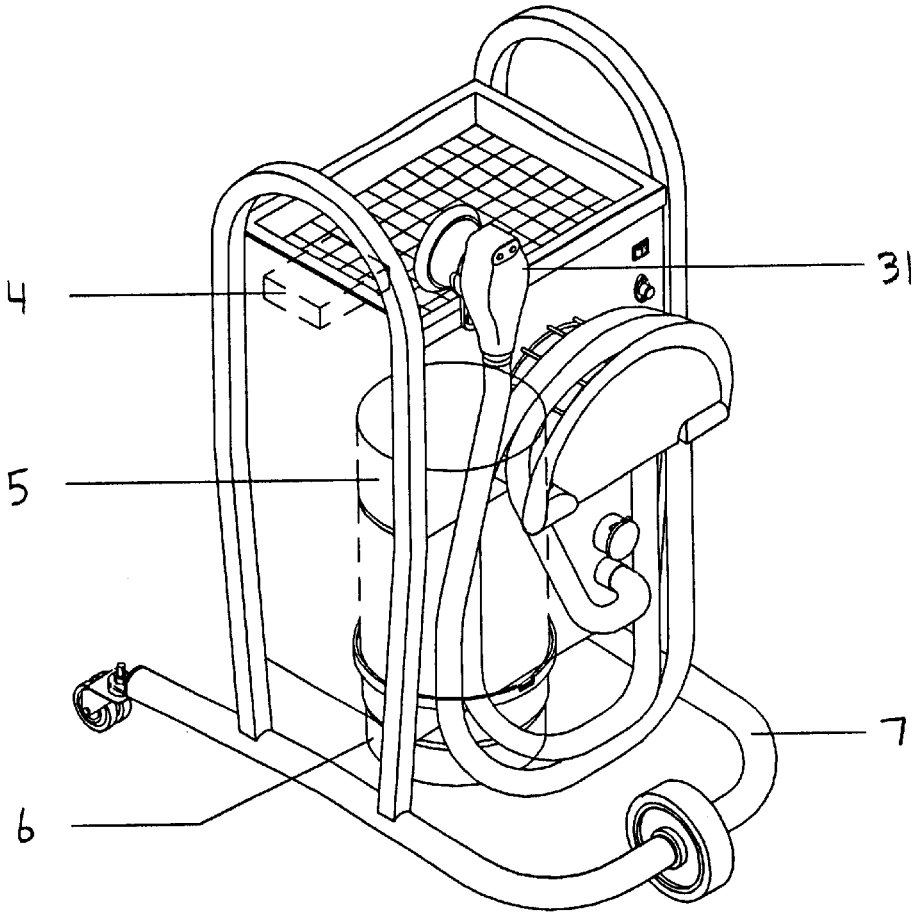

FIGURE #3
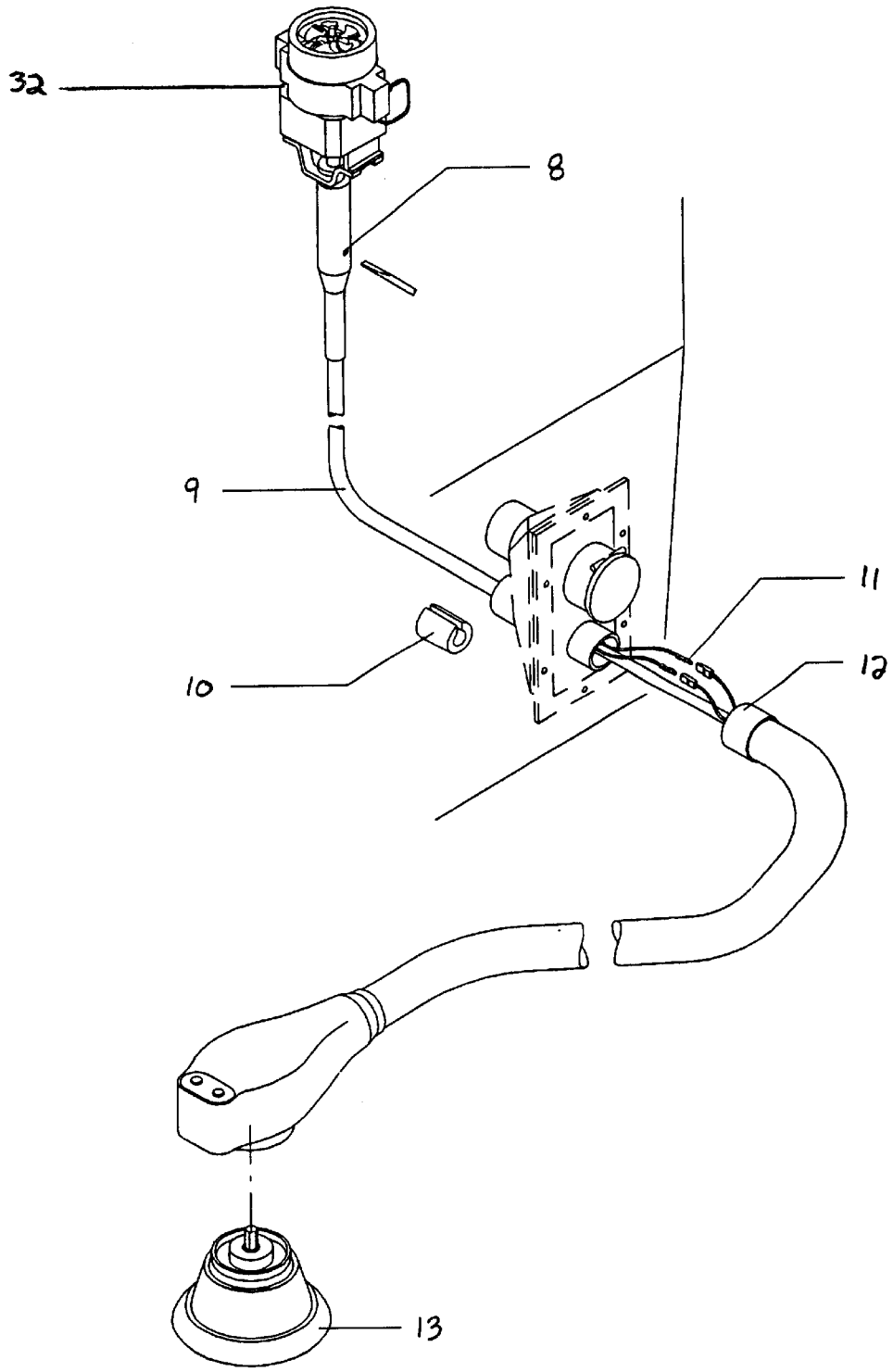

FIGURE # 4
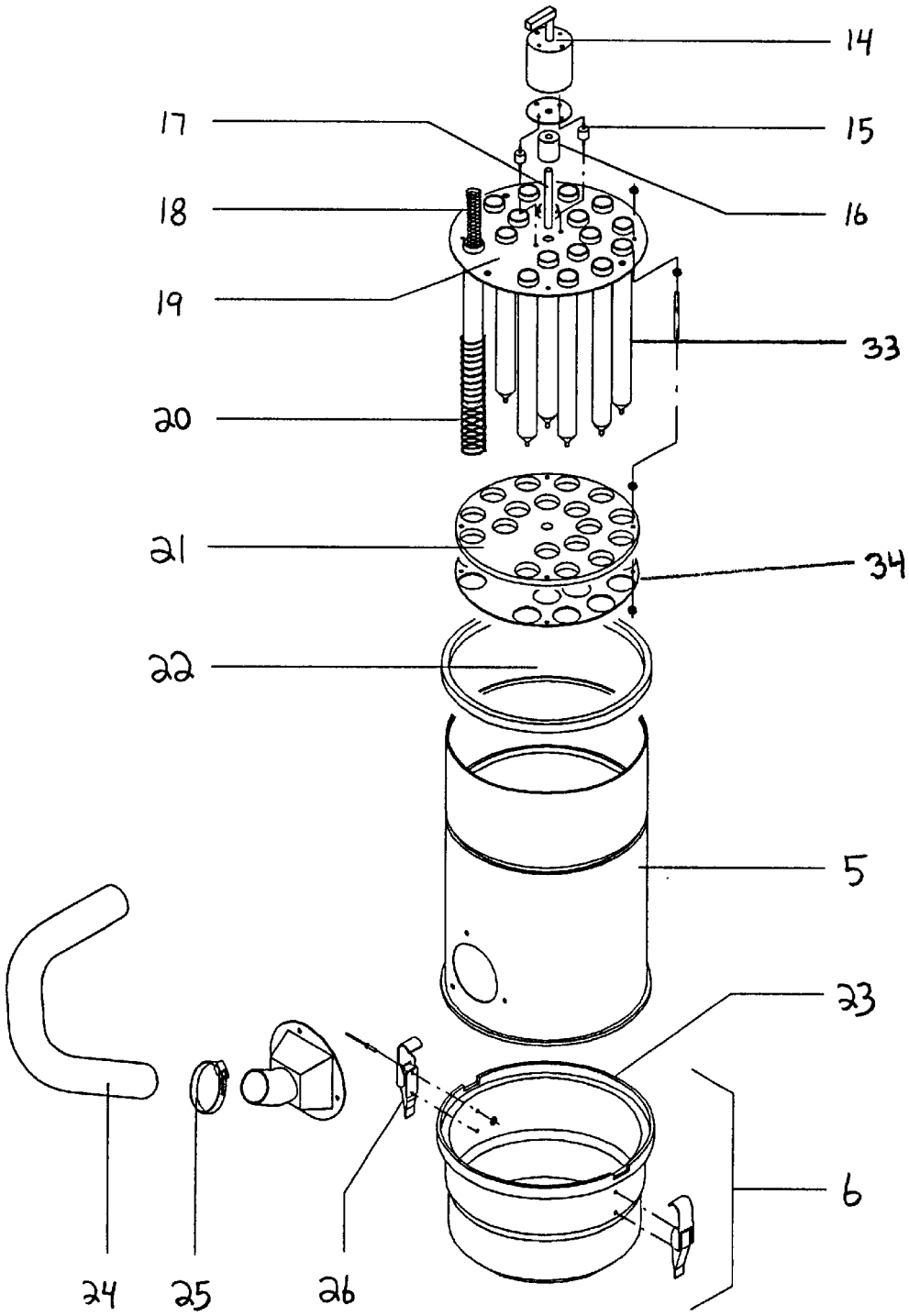

FIGURE #5
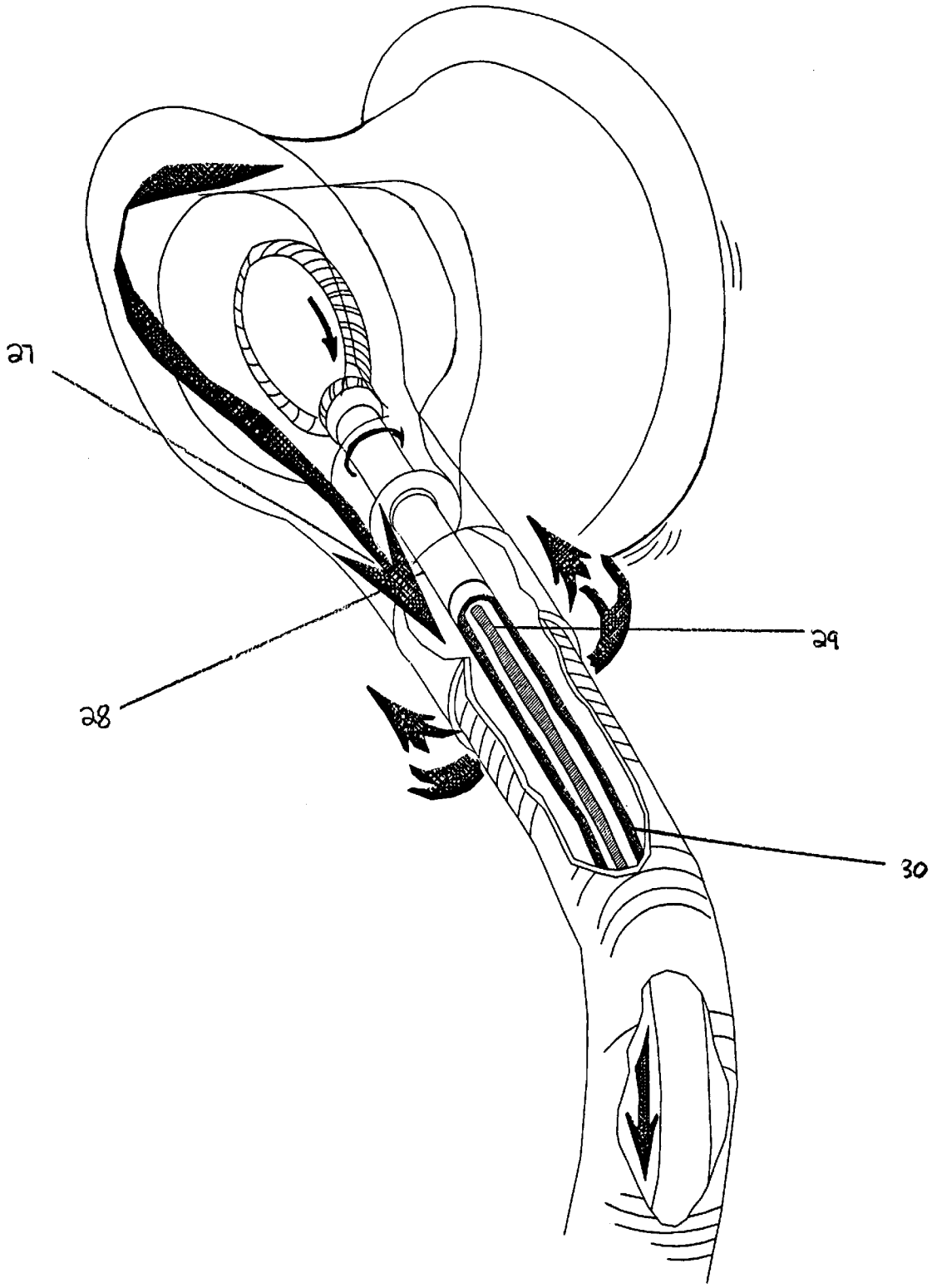

SANDING MACHINE

BACKGROUND

1. Field of Invention

This invention relates to a portable sanding machine which contains three motors which provide suction to remove debris, elect-magnetic vibrations to cleanse the filter springs and gyration to turn a driver cable and generate the spinning action of the abrasive head. This head is connected to the base unit via a hose which simultaneously transports the debris to a collection unit and houses a separate self-contained hose, containing lubrication, in which a driver cable is enclosed to turn the abrasive head.

2. Description of Prior Art

Heretofore many different arrangements were used to collect debris generated during the sanding process. These arrangements were very inefficient, costly and did not fully address the health concerns of the workers using this type of equipment. It is important to collect as much debris as possible, generated by the sanding process, so that it can not be breathed in by the user.

One arrangement which focuses upon the issue of improved collection capacity is Nishio, U.S. Pat. No. 5,713,785 (1998). It employs a special skirt member, located at its bottom edge, to sand a wider surface. It moves freely up and down the outer periphery of the body of the abrasive member and consequently incurs substantially more wear and tear than the inner portion. Although this configuration prevents less damage to the main sander body, it does not capture any more debris than a normal suction head.

Another arrangement, shown in Schuster, U.S. Pat. No. 3,872,627 (1975), utilizes a movable wall which serves as a damper to prevent the suction of foreign matter into the collector bag. This wall divides the discharge end of the duct supplying the air from the entry point of the suction duct thus diminishing the accumulation of foreign matter. Although this process decreases the likelihood of foreign matter igniting the contents of the collection bag, it does not filter out the smaller debris which escape into the air during the sanding process.

Robert, U.S. Pat. No. 4,164,101 (1979) utilizes a shaft casing to connect the sanding head to a motor which supplies power to turn the head. This allows the sanding head to be separate from the motor and gives the operator more flexibility to operate the head.

However, the major drawback is the intense degradation which the shaft casing encounters during the sanding process. Some other system needs to be employed to reduce this friction such as a self-lubrication process.

Another arrangement, shown in Marton, U.S. Pat. No 4,058,936 (1977) attempts to increase the suction of finer debris by increasing the number of openings on the abrasive head or sanding disc. Although the increased suction surface area allows a wider area for collection, it results in diminishing suction capacity because the finer debris accumulates inside the motor and air lines causing the air volume to be reduced.

Cheng, U.S. Pat. No. 5,131,192 (1992) utilizes a dust arrester affixed to a hollow workbench by way of a tubular filter unit axially rotatable inside the workbench. The filter contains a blowing unit which generates the air stream to blow the collected dust into a dust bin. This system also results in diminishing suction capacity due to the accumulation of finer debris.

OBJECTS AND ADVANTAGES

It is the object of my invention to provide a low-cost, safe, low-noise, light-weight, low-maintenance sanding machine which more efficiently collects debris and prevents the excess accumulation of debris on its movable parts. Currently, sanding machines are not capable of maintaining the high level of suction capacity required to capture accumulated debris. My invention employs a unique and revolutionary self-cleaning process to prevent this accumulation. A motor generates electromagnetic vibrations which excite metal cylinders, wrapped in springs, causing the debris to be shaken loose from the filters into the collection unit. This allows the surface of the cylinders to remain free of accumulated debris and ready to accept the temporary adhesion of further debris. The advantages of reduced debris and dust, in the atmosphere, are many. Foremost, is the reduced health risk associated with this type of activity. The lungs of the operator are damaged by the fine debris and dust generated by the sanding process. Even if the operator wears a filtration device, it can not trap all of the finer debris. In many cases, the operator does not wear such a device because it inhibits the efficiency of his work by limiting his vision and distorting his perception. It is therefore imperative that as much debris as possible be collected and not become airborne. It not only effects the lungs but can damage the eyes, inner ear and nasal passages and cause severe skin irritation disorders. Another advantage of increased collection is the decreased wear and tear on the machine caused by excessive accumulation of debris on moving parts. Not only does this shorten the life of the machine, and the cost of replacement and maintenance, but it makes the operation of this high-powered suction device more dangerous. My invention reduces the likelihood of workplace injuries due to equipment malfunction and decreases the risk of debris accumulating upon the ground and other areas which causes workers to slip and fall. The combination of increased worker safety, decreased health risks and decreased cost of maintaining the moving parts make my invention a low-cost, efficient and affordable alternative to more expensive, older, more dangerous sanding machines. Additionally, because the motors are housed separately, from the hand-held sanding unit, the noise level is substantially reduced thus causing less damage to the ear drums of the user and making the work place safer because the workers can communicate better with each other. Still another advantage of my invention is the special hose which connects the sanding unit to the unit which houses the motors. Although earlier sanding machines have utilized this concept, powering the sanding unit by a remote motor which powers a driver cable encased in a hose, my invention prevents degradation of the driver cable and hose. It accomplishes this by encasing the driver cable in a self-enclosed sheath which contains a self-lubricating liquid. This sheath is encased inside the hose. This allows the driver cable to be constantly lubricated thus the moving parts have a low coefficient of friction. This prolongs the life of the driver cable, makes it more efficient and prevents degradation of the outer sheath due to the rubbing action of the cable. Still another advantage of this self-contained sheath is to allow the collected debris to pass by, unobstructed, along the sides of the sheath from the sanding unit to the collection unit. This could be accomplished by a separate hose. However, it is much more advantageous to only have one hose connect the sanding unit to the filter collection unit. It gives the operator more range of motion. It is easier to move the sanding head if only one hose is attached, increasing the quality of his work. It also makes the sanding head more light-weight and thus the user is not fatigued as easily thus increasing his alertness and dexterity. It reduces the cost of the unit by utilizing one hose and consequently the maintenance. It increases the safety of the work area because there are less hoses to trip over and cause potential problems.

BRIEF DESCRIPTION OF THE DRAWINGS

FIG. 1 shows the outside of the base unit which houses the motors and dust collection container and shows a cut-away view of the top housing plate when removed.

FIG. 2 shows a view from the side of the base unit and a fade-in view of the dust collection container located inside the base unit.

FIG. 3 shows a segmented view of the suction motor and the hose with attaches it to the hand-held sanding unit.

FIG. 4 shows the motor which excites the filter springs and the entire filter assembly and collection unit it sits on top of.

FIG. 5 shows the dual-purpose hose which connects the sanding head to the base unit.

SUMMARY

My invention is a sanding machine which utilizes a powerful industrial vacuum machine to drive a hand-held sanding unit with can accept multiple sanding heads. The hand-held unit, which contains no motor, is connected to the vacuum machine through a single hose. This hose has a dual purpose. It contains a driver cable and provides air suction to transport the debris back to the bas-unit vacuum machine, through the main hose for collection. The driver cable is wrapped inside a self-contained hose and has lubricating fluid to continuously lubricate the cable during operation. The driver cable, powered by the base-unit powers the hand-held unit. Thus, the main hose has a self-contained driver cable hose running through the middle and additionally allows the collected debris to simultaneously be transported back to the base-unit for collection. The vacuum machine, base-unit, is comprised of three motors, a filter container and a dust collection container. The first motor generates power to turn the driver cable. The second motor generates the suction for pulling the debris back through the main hose. The third motor supplies vibrations for the springs, in the filter container. This filter container is comprised of sixteen metal cylinders wrapped in metal springs. The motor generates sufficient electro-magnetic vibrations to excite the springs and make the cylinders self-cleaning. The debris, which collects upon the cylinders, is shaken loose by the vibrations of the springs and falls downward into the dust collector. The head of the hand-held unit is interchangeable allowing different tools, or movements, to be attached. When the driver motor stops, while the user changes the sand paper or sanding head, the electromagnetic vibrating motor runs for approximately 20 seconds and shakes the debris off of the cylinders and runs for approximately 10 minutes after the user has finished the sanding operation to completely clean the cylinders.

PREFERRED EMBODIMENT—DESCRIPTION

Operation of my invention is simple and straightforward. A base-unit houses three motors which power the driver cable to rotate the sanding head, provide suction to suck the debris back into the base unit adhering it to the cleaning cylinders and electro-magnetically stimulate the cleaning cylinders causing them to release the debris downward into a collection receptacle. A single hose houses both the driver cable, used to turn the sanding head, and a pathway for the debris to be sucked back into the base unit. The driver cable is additionally encased in a protective sheath containing a self-lubricating liquid to prevent damage to the driver cable and sheath and also prevents contamination of the debris with the driver cable.

In FIG. 1, the top cover, 1, is lifted off to reveal the top of the base unit. The electronic power box, 2, sits directly underneath the cover, 1, next to the driver cable motor, and is connected to the three motors by a connector receptor, 3. In FIG. 2, the collection unit, 5, is located inside the base unit and houses the electro-magnetic motor and filtration unit. The bottom of the collection unit is denoted as, 6, and can be detached to empty the debris. The base unit is fitted upon a trolley, 7, allowing the unit to be wheeled to any location. The hand-held sanding unit, 31, is pictured resting upon the top of the base unit. In FIG. 3, the driver cable motor, 32, is attached to a securing piece, 8, and hose, 9, secured by a connecting clamp, 10. Said, hose, 9, contains the electrical connections, 11, which run inside the hose, 9. The interchangeable sanding head, 13, connects to the end of the hand-held unit. In FIG. 4, the electromagnetic motor, 14, generates vibrations. The rubber vibration isolator, 15, gives the springs a rotating movement so the entire surface of the filters, 33, is shaken. Without the isolator, 15, the outside metal cleaning springs, 20, would only clean in a horizontal and vertical direction and not a side-ways motion. A foam pad, 16, is inserted through the connecting rod, 17, which connects the motor, 14, and the metal filter plate, 19 to the bottom metal securing plate, 21. The purpose of the foam pad, 16, is to inhibit the upward accumulation of debris onto the motor, 14 and limit the movement of the connecting rod, 17. The polystyrene filters, 33, are secured into the metal filter plate, 19, and have at their center a metal spring, 18, and are encased on the outside by a larger metal spring, 20, which vibrates in conjunction with the inner spring, 18, to loosen the debris from the filters, 33. The diameter of the bottom metal securing plate, 21, is slightly less than the metal filter plate, 19, which is approximately the same diameter as the distance between the canister walls. A foam pad, 34, helps to hold the bottom metal securing plate, 21, in place. Located below the foam pad, 34, is a rubber ring, 22, which helps to form a tight seal with the collection unit, 5. The bottom of the collection unit, 6, is secured to the collection unit, 5, with a grooved lip, 23, and can be detached to discard the collected debris by undoing the holding clips, 26. The debris enters the collection unit through a hose, 24, which is secured with a clamp. Inside the collection unit, 5, a cyclone effect induces the heavier debris to fall downward into the bottom of the collection unit 6, and the finer particles rise to the top and adhere to the filters, 33, which release the particles when scraped by the metal springs, 20. In FIG. 5, the debris is sucked backwards, 27, through the hose. Inside the hose, is an inner hose, 28, which contains the driver cable, 29, and a self-lubricating fluid, 30.

CONCLUSIONS, RAMIFICATIONS AND SCOPE

It can be seen that, according to the invention, the sanding machine consists of a hand-held sanding unit, with interchangeable heads, connected to a base unit. The base unit contains three motors which provide power to turn the sanding unit, suction to pull the debris back from the sanding unit and electromagnetic vibrations to stimulate the springs which clean the filters. A hose, containing a self-encased sheath which contains the driver cable for the rotating sanding head and a self lubricating fluid, allows the debris to be transported backward to a collection unit in the base unit. Said collection unit encases the filtration cleaning process and filters.

Although the description above contains many specificities, these should not be construed as limiting the scope of the invention but merely provide illustrations of some of the presently preferred embodiments of this invention. Various other embodiments and ramifications are possible within its scope.

Thus the scope of the invention should be determined by the appended claims and their legal equivalents, rather that by the examples given.

I claim:

1. A sanding machine, comprising:

A hand-held sanding unit, with interchangeable heads, connected to a portable base unit which houses three motors and a collection receptacle for debris;

A collection receptacle containing a motor which generates electromagnetic vibrations, said motor is connected to a rod, encased in a circular foam pad, which is inserted through the middle of a circular metal disc, and additionally attached to the disc with two circular rubber vibration isolators, said disc having cylindrical filtration devices adhered thereto, said cylindrical filtration devices having a metal spring as their inner core, an outer shell of polystyrene which is encased by a metal spring, said devices are additionally held in place by a bottom metal securing plate with a separate foam bottom plate and affixed to a collection device;

A hose connecting the sanding unit and the base unit which has an additional hose, within itself, containing a driver cable for the sanding unit, surrounded by self lubricating fluid, of lesser diameter so as to allow the collected debris to travel backwards between the outside of the inner hose and the inside of the outside house;

A second motor, located in the base unit, which provides suction for the debris;

A third motor, located in the base unit, which turns the driver cable.

* * * * *